US005700129A

United States Patent [19]

Kocian

[11] Patent Number: 5,700,129

[45] Date of Patent: Dec. 23, 1997

[54] TEMPERATURE-ADJUSTABLE COMPRESSOR GUIDE VANE RING

[75] Inventor: Frank Kocian, Neckartailfingen, Germany

[73] Assignee: Deutsche Forschungsanstalt fuer Luft- und Raumfahrt e.V., Bonn, Germany

[21] Appl. No.: 642,340

[22] Filed: May 3, 1996

[30] Foreign Application Priority Data

May 4, 1995 [DE] Germany ..... 195 16 382.6

[51] Int. Cl.[6] ..... F01D 9/04; F01D 25/26

[52] U.S. Cl. ..... 415/138; 415/136; 415/160; 415/178; 415/200; 403/30

[58] Field of Search ..... 415/12, 136, 138, 415/139, 159, 160, 161, 162, 177, 178, 200; 403/28, 30

[56] References Cited

U.S. PATENT DOCUMENTS

| | | | |
|---|---|---|---|
| 2,970,808 | 2/1961 | Coppa | 415/12 |
| 3,685,920 | 8/1972 | Burge | 415/160 |
| 4,786,232 | 11/1988 | Davis et al. | 415/138 |
| 4,812,106 | 3/1989 | Purgavie | 415/139 |
| 4,925,364 | 5/1990 | Das | 415/162 |
| 5,004,402 | 4/1991 | Burchette et al. | 415/138 |
| 5,447,411 | 9/1995 | Curley et al. | 415/200 |
| 5,516,257 | 5/1996 | Kasprow et al. | 415/200 |

*Primary Examiner*—Christopher Verdier
*Attorney, Agent, or Firm*—Barry R. Lipsitz; Ralph F. Hoppin

[57] ABSTRACT

In order to create an adjusting ring for the synchronous alteration of the angle of pitch of guide vanes of a compressor having several bearing points for mounting on a compressor housing of the compressor, which can be manufactured at least partially from materials with a low coefficient of thermal expansion and is, nevertheless, compatible with a metallic compressor housing with respect to temperature, it is suggested that the adjusting ring comprise curved ring segments each arranged between two adjacent bearing points, the curvature of the ring segments decreasing during an increase in the temperature of the ring segments so that the bearing points between the ring segments are displaced outwards in a radial direction.

22 Claims, 5 Drawing Sheets

TEMPERATURE-ADJUSTABLE COMPRESSOR GUIDE VANE RING

BACKGROUND OF THE INVENTION

The present invention relates to an adjusting ring for the synchronous alteration of the angle of pitch of guide vanes of a compressor which has several bearing points for mounting on a housing of the compressor.

Adjusting rings of this type serve, in particular, in aeronautical engineering to adapt the compressor to different operating conditions by adjusting the guide vanes in order to make an optimum operation of the compressor possible with differing requirement profiles.

Up to now, adjusting rings of this type have been produced completely of metal, for example titanium, at least for the hot area of the compressor.

In order to be able to reduce the production costs as well as decrease the weight of the adjusting ring considerably it would be desirable to manufacture such an adjusting ring at least partially from non-metallic materials which, with a comparable strength and rigidity, allow a lighter construction than is the case with metallic materials.

A simple replacement of the metallic materials by non-metallic materials while retaining the construction principle of the adjusting ring can generally, however, not be carried out, at least with respect to the hot area, since the non-metallic materials which can be considered for use normally have considerably lower coefficients of thermal expansion then the metallic compressor housing and the adjusting ring would, therefore, shrink onto the expanding compressor housing during increases in temperature occurring during the operation of the compressor. This means that the adjusting ring would no longer be displaceable relative to the compressor housing and, therefore, could no longer serve to synchronously alter the angle of pitch of the guide vanes of the compressor.

SUMMARY OF THE INVENTION

The object underlying the invention was therefore to create an adjusting ring which can be produced at least partially from materials with a low coefficient of thermal expansion and is, nevertheless, compatible with a metallic compressor housing with respect to temperature.

This object is accomplished in an adjusting ring of the type specified at the outset in that the adjusting ring comprises curved ring segments each arranged between two adjacent bearing points, the curvature of these ring segments decreasing during an increase in the temperature of the ring segments so that the bearing points between the ring segments are displaced outwards in a radial direction.

The inventive concept offers the advantage that due to an alteration in the geometry of the adjusting ring the bearing points of this adjusting ring are displaced outwards in radial direction to a sufficient extent to avoid the adjusting ring shrinking onto the compressor housing. A homogeneous thermal expansion of the adjusting ring is not necessary for the thermal expansion compatibility between the adjusting ring and the compressor housing and so the adjusting ring can be produced with the necessary structural rigidity at least partially from non-metallic materials having a very small, infinitesimal or even negative coefficient of thermal expansion and sufficient rigidity.

It is quite generally possible, using this concept accordingly, to provide the thermal expansion compatibility between a ring-shaped or tubular carrier and a ring-shaped or tubular, supported element, which is mounted on the carrier at bearing points, surrounds this carrier or is surrounded by it and comprises a material with a lower thermal expansion than that of the material of the carrier, in that the supported element is divided along its circumference into ring or tubular segments each arranged between two bearing points, the curvature of these segments decreasing during an increase in the temperature of the supported element so that the bearing points are displaced outwards in a radial direction.

If the supported element comprises a material with a greater thermal expansion than that of the material of the carrier, it is provided for the curvature of the ring or tubular segments to increase when the temperature increases so that the bearing points are displaced inwards in a radial direction.

The adjusting ring advantageously comprises at least three ring segments in order to maintain an adequate number of bearing points for the mounting of the adjusting ring on the compressor housing.

On the other hand, the effect of altering the geometry diminishes with an increasing number of ring segments, into which the adjusting ring is divided, while the production costs of the adjusting ring rise and so it is of advantage when the adjusting ring comprises at the most 16 ring segments.

Embodiments of the adjusting ring with six to ten ring segments are particularly preferred.

The decrease in curvature of the ring segments during an increase in temperature may be advantageously achieved when the ring segments each comprise a circumferential member which is arranged on the outer side of the adjusting ring and has a first coefficient of thermal expansion in circumferential direction of the adjusting ring and a bearer which is arranged on the inner side of the adjusting ring and has a second coefficient of thermal expansion in circumferential direction of the adjusting ring, the second coefficient of thermal expansion being greater than the first coefficient of thermal expansion and the circumferential member and the bearer of each ring segment being secured against one another such that the curvature of the ring segments decreases when the temperature of the ring segments increases. The required alteration in the geometry of the adjusting ring is thereby brought about during an increase in the temperature of the ring segments by an effect similar to the bimetallic effect known from temperature sensing strips. The circumferential parts of the ring segments at least can be manufactured from a non-metallic material.

In order to bring about an increase in the curvature of the ring segments during an increase in temperature, the bearers would have to be arranged on the outer side instead of the inner side of the adjusting ring.

In order to bring about a considerable reduction in weight whilst retaining a structural rigidity of the adjusting ring necessary for an exact adjustment of the guide vanes, it is, furthermore, favorable when the circumferential members consist at least partially of a fiber composite material.

This composite material can, for example, be a carbon fiber composite or a glass fiber composite.

It is particularly favorable when the fibers of the fiber composite material are aligned essentially in circumferential direction of the adjusting ring. This means that a particularly high rigidity and strength of the adjusting ring are achieved in circumferential direction.

Any material which has a plainly higher coefficient of thermal expansion that the material of the circumferential members, also and in particular a fiber composite material with a corresponding coefficient of thermal expansion, can be considered as material for the bearers.

For reasons of reducing the weight an embodiment of the adjusting ring is particularly preferred, in which the bearers consist at least partially of aluminum, in particular an aluminum powder alloy.

The circumferential members of each ring segment of the adjusting ring can be manufactured as individual parts and not be joined to one another until the adjusting ring is assembled.

To simplify the production of the adjusting ring as well as increase the rigidity of it, it is, however, of advantage when the circumferential members of several adjacent ring segments are designed in one piece with one another.

It is favorable when the circumferential members of the ring segments are designed as two circumferential half rings since, in this way, an advantageous compromise between assembly and production requirements is achieved.

It is particularly favorable when the circumferential members of all the ring segments are designed in one piece with one another.

A further development of the invention relates to a compressor with a compressor housing, guide vanes and an adjusting ring for the synchronous alteration of the angle of pitch of the guide vanes, with which the adjusting ring is an adjusting ring as discussed.

In order to be able to move the adjusting ring along its circumference relative to the compressor housing without any great force being necessary, it is of advantage when the compressor comprises sliding shoes, on which the adjusting ring is mounted and which each have a sliding surface for sliding on the compressor housing.

These sliding shoes can also consist advantageously of a fiber composite material in order to achieve a reduction in weight.

Furthermore, it is favorable when the relative movement between the adjusting ring and the compressor housing is made easier by the compressor housing comprising adjusting ring carriers which each have a sliding surface.

It is particularly advantageous when the compressor comprises not only sliding shoes but also adjusting ring carriers, whereby the sliding surfaces of the sliding shoes can slide along the sliding surfaces of the adjusting ring carriers.

Furthermore, the adjusting ring carriers favorably consist of a fiber composite material in order to reduce the weight further.

In a preferred embodiment of the adjusting ring carriers these have a layered structure, in which dense fabric layers and less dense spacer layers alternate in an axial direction of the compressor. Due to cavities contained in the spacer layers, the weight of the adjusting ring carriers is reduced in a particularly effective manner.

It is favorable when the fabric layers have a negative coefficient of thermal expansion in the radial direction of the compressor. In this case, the adjusting ring carriers are shortened in the radial direction of the compressor when the temperature is increased and thus partially compensate the expansion of the compressor housing. This means that a smaller displacement of the bearing points of the adjusting ring in radial direction outwards is already sufficient to ensure the thermal expansion compatibility between the adjusting ring and the compressor housing.

A negative coefficient of thermal expansion of the fabric layers in radial direction, which is particularly large with respect to the amount, may be achieved when the fabric layers comprise fibers which are aligned at an angle of approximately plus 30° in relation to the radial direction of the compressor and fibers which are aligned at an angle of approximately minus 30° in relation to the radial direction of the compressor.

To minimize the thermal load on the adjusting ring, it is, in addition, of advantage when a thermal insulation layer is arranged between the compressor housing and each of the adjusting ring carriers.

It is favorable when the coefficients of thermal expansion of circumferential members and bearers of the ring segments are adapted to one another and to the length and the curvature of the ring segments such that the bearing points of the adjusting ring are displaced radially outwards during an increase in the temperature essentially over the same distance as the adjusting ring carriers. This means that the clearance during an operating cycle (heating up to operating temperature and cooling down of the compressor) can be kept small at the bearing points of the adjusting ring so that the position of the adjusting ring is exactly defined and the angles of pitch of the guide vanes of the compressor can be set exactly. For this purpose, it is necessary for the effective specific thermal expansion of the adjusting ring at the bearing points to be greater than the specific thermal expansion of the compressor housing since the adjusting ring has, in the operating state, a lower temperature than the compressor housing.

Additional features and advantages of the invention are the subject matter of the following description and the drawings of one embodiment.

DETAILED DESCRIPTION OF THE INVENTION

Figure 1:
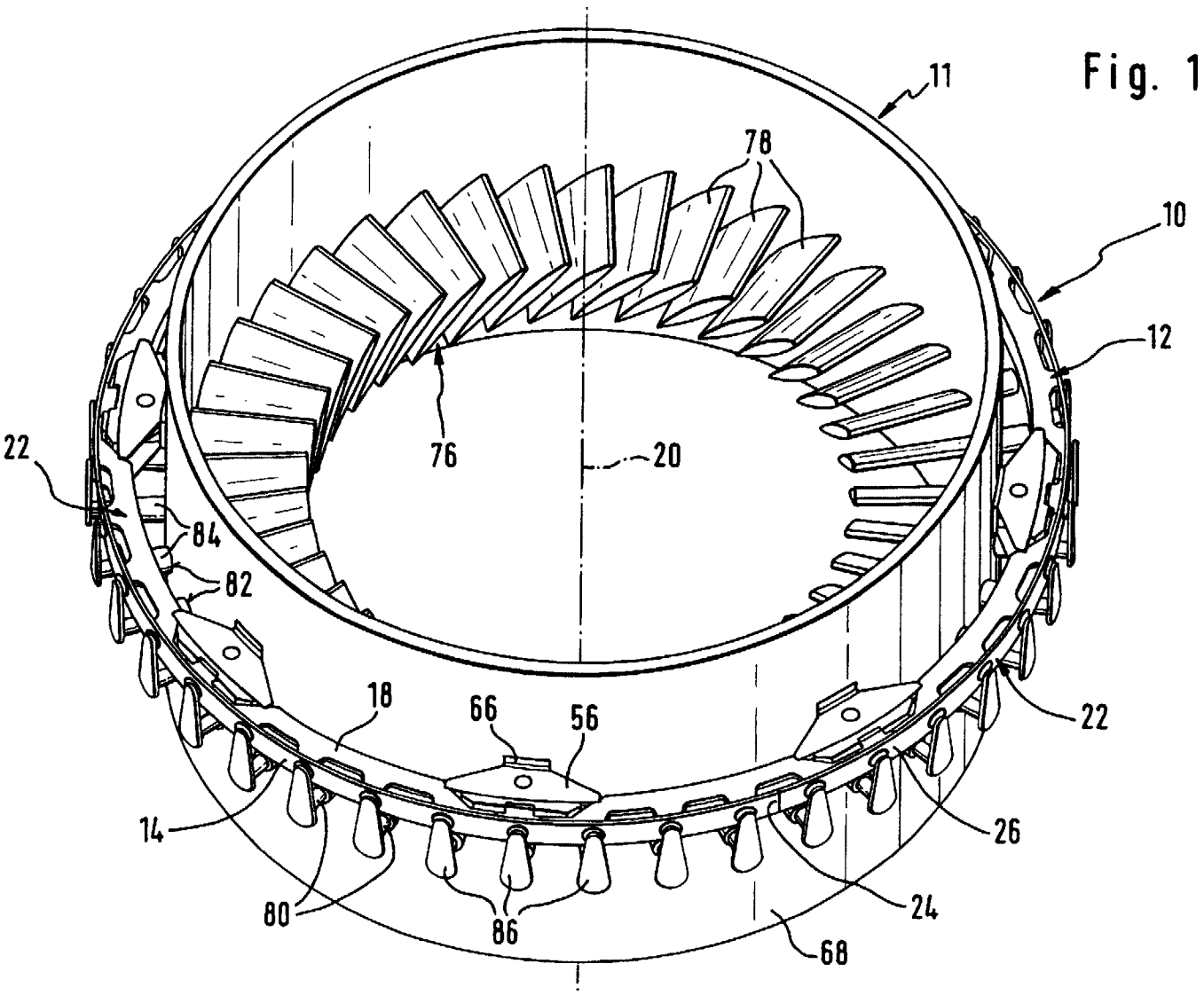
FIG. 1 is a perspective illustration of an inventive adjusting ring mounted on a compressor housing for the synchronous alteration of the angle of pitch of guide vanes of the compressor.

Elements which are the same or functionally equivalent are designated in all the Figures with the same reference numerals.

Figure 2:
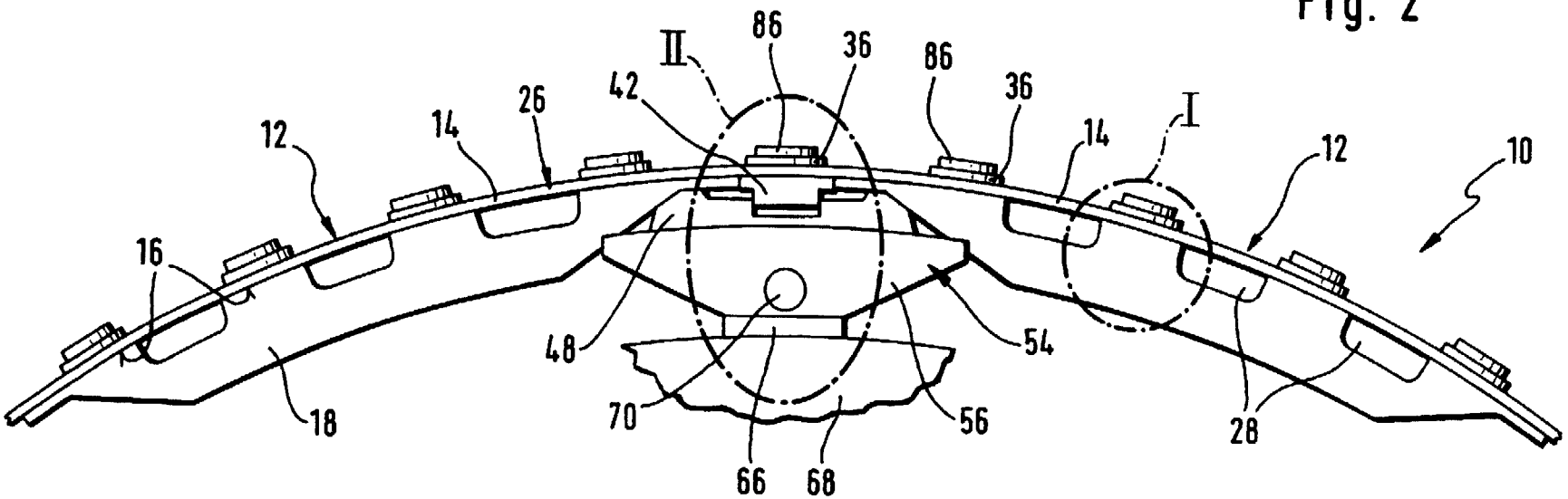
FIG. 2 is a plan view of two adjacent ring segments of the adjusting ring from FIG. 1 with a bearing point located therebetween.

An inventive adjusting ring 10, illustrated in FIG. 1, of a compressor designated as a whole as 11 comprises several, for example eight, essentially circular ring segments 12, of which two adjacent ring segments 12 are illustrated on an enlarged scale in FIG. 2.

Each of the ring segments 12 comprises a circumferential member 14 in the form of a circular ring section arranged on the outer side of the adjusting ring 10 as well as a bearer 18 which is secured at the inner side Of the circumferential member 14, for example at four contact surfaces 16, and projects from the inner side of the circumferential member 14 towards an axis 20 of the adjusting ring 10.

The circumferential members 14 consist of such a material that they have along the circumferential direction of the adjusting ring 10 a small, infinitesimal or even negative coefficient of thermal expansion.

This may be achieved, for example, by manufacturing the circumferential members 14 from a carbon fiber composite material, with the carbon fibers aligned parallel to the circumferential direction of the adjusting ring 10. In this case, the coefficient of thermal expansion for the expansion along the ring circumference disappears practically completely.

As an alternative or supplementary to a carbon fiber composite material, the circumferential members 14 can also be manufactured from a glass fiber composite material. In this case, the coefficient of thermal expansion for the expansion along the ring circumference is clearly in the positive range but is, however, still only about half the coefficient of thermal expansion of the metallic compressor housing.

In the embodiment of the inventive adjusting ring illustrated in FIGS. 1 to 5, four adjacent circumferential members 14 are designed each time in one piece with one another and form a circumferential half ring 22. The two circumferential half rings 22 thus resulting are secured against one another at two connecting points 24 (only one of which is to be seen in FIG. 1) and thus form a complete, closed circumferential ring 26.

Each of the bearers 18 has essentially the shape of a section of a hollow ring profile with a rectangular cross section, the side wall of the profile facing the respective circumferential member 14 having the same height as the circumferential member 14 and being flush with the same. Each bearer 18 is beveled at both ends and, to reduce the weight, has, for example, three recesses 28 arranged between the contact surfaces 16.

Figure 3:
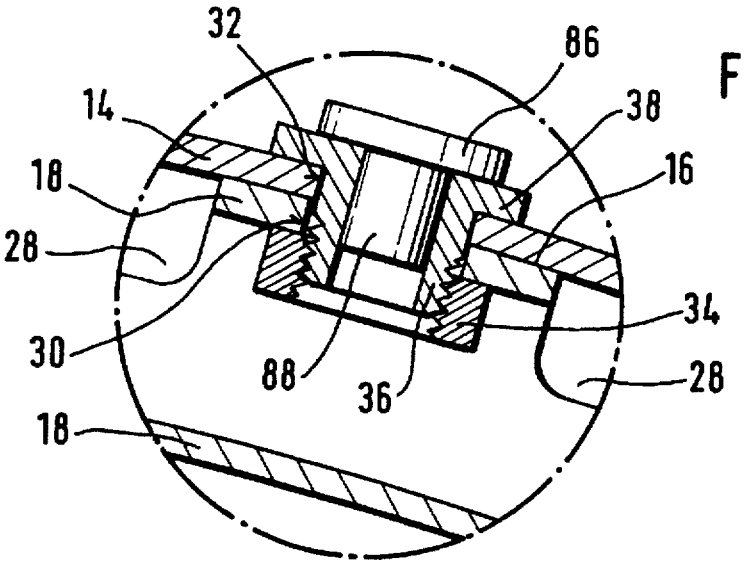
FIG. 3 is a section through the adjusting ring along the central plane thereof in the area I of FIG. 2.

Each bearer 18 has in the region of each of its, for example four, contact surfaces 16 a respective radial through-hole 30 which is aligned each time with a corresponding, radial through-hole 32 in the associated circumferential member 14, as illustrated in FIG. 3.

A threaded insert 34 provided with an internal thread is arranged at the opening, which is located inwards in radial direction, of each through-hole 30 in each of the bearers 18 and a hollow-cylindrical guide sleeve 36 provided with an external thread is screwed into this threaded insert 34. The guide sleeve 36 passes through the through-holes 30 and 32 in the bearer 18 and the associated circumferential member 14, respectively, and bears at its end located outwards in radial direction a rim 38 which rests on the outer side of the circumferential member 14. The bearers 18 are secured to the associated circumferential members 14 by means of the guide sleeves 36 in conjunction with a respective threaded insert 34.

The bearers 18 are manufactured from a material which has a high coefficient of thermal expansion at least in the circumferential direction of the adjusting ring 10.

For example, an aluminum powder alloy can be used which, furthermore, ensures a sufficient flexural stiffness of the ring segments 12 even at high temperatures.

The through-holes 32 in the circumferential members 14 are arranged equidistant to one another along the circumference of the circumferential members 14.

In addition, an additional, radial through-hole 40 is provided in the circumferential ring 26 at each of the points located between two respective bearers 18, at which two adjacent ring segments 12 border on one another. This through-hole 40 has the same distance from the through-holes 32 adjacent to it as two through-holes 32 immediately adjacent one another.

Figure 4:
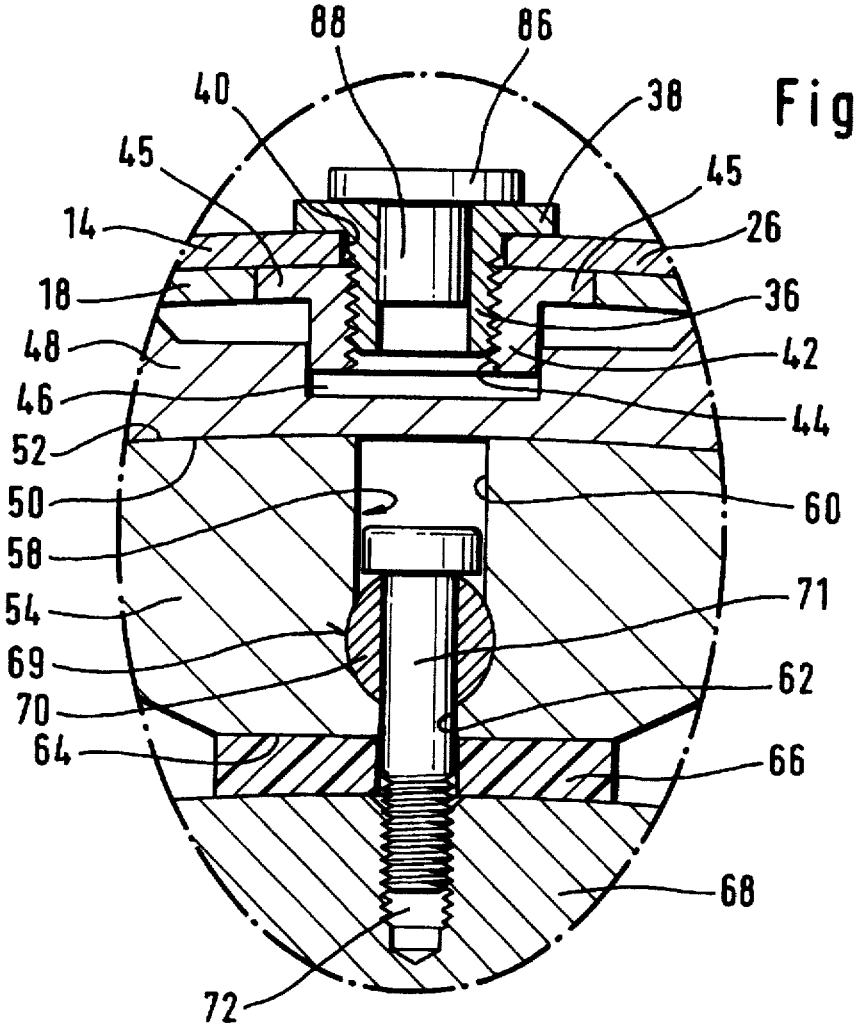
FIG. 4 is a section through the adjusting ring and the compressor housing along the central plane of the adjusting ring in the area II of FIG. 2.

An essentially parallelepiped bearing block 42 is arranged each time on the inner side of the circumferential ring 26 such that a threaded bore 44 passing centrally through the bearing block 42 in radial direction of the compressor 11 is aligned with the through-hole 40 in the circumferential ring 26, as illustrated in FIG. 4.

In addition, each bearing block 42 has two shoulders 45 which project from the bearing block 42 in opposite directions to one another in circumferential direction of the adjusting ring 10 and abut not only on the inner side of a respective circumferential member 14 but also on a respective bearer 18.

A hollow-cylindrical guide sleeve 36 provided with an external thread is screwed into the threaded bore 44, passes through the through-hole 40 in the circumferential ring 26 and rests with its rim 38 on the outer side of the circumferential ring 26.

The region of the bearing block 42 located inwards in radial direction is guided for displacement with slight clearance in radial direction in an essentially parallelepiped recess 46 of a sliding shoe 48.

The adjusting ring 10 is supported on the sliding shoe 48 at the outer surfaces of the bearing blocks 42 aligned in radial direction of the compressor. The bearing blocks 42 therefore represent bearing points of the adjusting ring 10.

A concave sliding surface 50 of the sliding shoe 48 which is located inwards in radial direction and faces away from the bearing block 42 has the shape of a section from a circular ring surface, is provided with a slide coating and rests on a correspondingly curved, convex sliding surface 52 of an adjusting ring carrier designated as centralizer 54. Since the amount and direction of the curvatures of the concave sliding surface S0 of the sliding shoe 48, on the one hand, and of the convex sliding surface 52 of the centralizer 54 are coordinated with one another, each sliding shoe 48 can slide along on the associated centralizer 54 in circumferential direction of the adjusting ring 10.

Each centralizer 54 has an upper and a lower guide plate 56 each essentially trapezoidal and the bearers 18 of the ring segments 12 adjacent the respective centralizer 54 are guided between the plates during a movement of the adjusting ring 10 along its circumference. In this respect, the clear distance between the two guide plates 56 of each centralizer is somewhat larger than the height of the bearers 18.

Furthermore, each of the centralizers 54 has a stepped, central, radial through-hole 58 which comprises a broader section 60 located outwards in radial direction and a narrower section 62 located inwards in radial direction.

The narrower section 62 of the stepped through-hole 58 opens onto a base surface 64 of the centralizer 54 which is located inwards in radial direction and rests on an essentially parallelepiped insulation block 66 which, for its part, is borne by an essentially hollow-cylindrical compressor housing 68 arranged coaxially to the adjusting ring 10.

The centralizer 54 is penetrated vertically to the guide plates 56 by an additional through-hole 69 which intersects the stepped through-hole 58 and into which a cylindrical pin 70 is inserted such that a central radial through-hole of the pin is aligned with the narrower section 62 of the stepped through-hole 58.

Each centralizer 54 is secured in position by means of a screw 71 which passes through the through-hole in the pin 70, the narrower section 62 of the stepped through-hole 58 and a through-hole in the insulation block 66 aligned therewith, is screwed into a radial threaded hole 72 in the compressor housing 68 and rests on the pin 70 with its head. A good coupling-in of force into the centralizer 54 is achieved by way of the pin 70.

The centralizers 54 can be manufactured from carbon fiber composite material so that they have a slight positive, an infinitesimal or a negative coefficient of thermal expansion.

Figure 5:
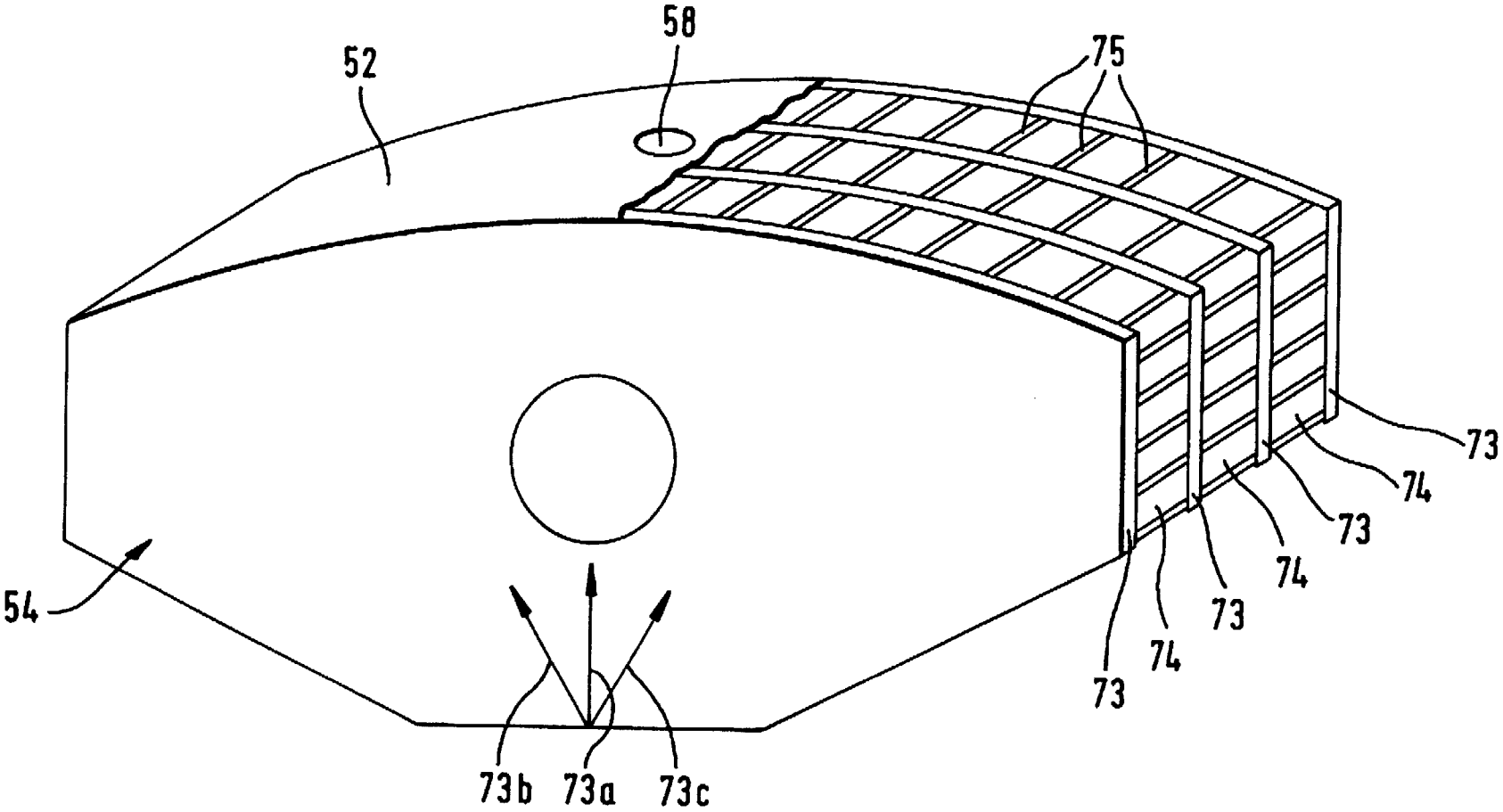
FIG. 5 is a schematic, perspective, partially cutaway illustration of an adjusting ring carrier (centralizer)

A layered structure of the centralizer material which is advantageous for achieving a negative coefficient of thermal expansion in radial direction as well as a low weight is illustrated in FIG. 5.

With this layered structure, dense fabric layers 73 and less dense spacer layers 74, which comprise webs 75 of spacer fabric aligned transversely to the fabric layers 73, follow one another in axial direction of the compressor.

The fabric layers 73 comprise fibers which are arranged at an angle of approximately plus 30° in relation to the radial direction of the compressor and fibers which are aligned at an angle of approximately minus 30° in relation to the radial direction of the compressor in order to obtain a negative coefficient of thermal expansion of the centralizer 54 in radial direction of the compressor which is, with respect to the amount, as large as possible.

In FIG. 5, the radial direction of the compressor is illustrated by the arrow 73*a* and the directions, in which the fibers of the fabric layers 73 are aligned, by the arrows 73*b* and 73*c*.

The insulation blocks 66 can be manufactured from a plastics material which is unaffected by high temperatures and has a high heat resistance so that the amount of heat transferred from the compressor housing 68 to the adjusting ring 10 via the centralizer 54 during operation of the compressor and, therefore, the thermal load on the adjusting ring 10 is kept as low as possible.

A grid 76 of guide vanes consisting of forty guide vanes 78 (in the embodiment illustrated in FIG. 1) is arranged along the inner wall of the hollow-cylindrical compressor housing 68. All the guide vanes 78 are aligned at the same angle of pitch with respect to the common axis 20 of the adjusting ring 10 and the compressor housing 68. Each of the guide vanes 78 has an adjusting shaft 80 which projects outwards in radial direction, passes through a respective radial through-hole 82 in the compressor housing 68 and a respective bearing sleeve 84, which is coaxial to the adjusting shaft 80 and arranged on the outer wall of the compressor housing 68, and is non-rotatably connected at its free end to an adjusting arm 86 aligned vertically to the axis of the adjusting shaft 80.

Each of the adjusting arms 86 bears at its free end an articulated rod pin 88 which protrudes inwards in radial direction and is mounted in one of the respective guide sleeves 36 of the circumferential ring 26. This means that an articulated connection is provided between the adjusting ring 10, on the one hand, and the grid 76 of guide vanes, on the other hand.

This articulated connection allows the angle of pitch of all the guide vanes 78 of the grid 76 of guide vanes to be altered exactly synchronously.

In a resting position of the adjusting ring 10 illustrated in FIG. 1, the bearers 18 of the adjusting ring 10 are arranged centrally between two adjacent centralizers 54, and the adjusting arms 86 are aligned parallel to the axis 20 of the adjusting ring 10 and the compressor housing 68. In this position of the adjusting ring 10, the guide vanes 78 are aligned at a resting angle of pitch in relation to the axis 20.

If the adjusting ring 10 is now turned along its circumference in relation to the compressor housing 68 in the clockwise direction, when seen from above, by a moving mechanism (not illustrated), the articulated rod pins 88 in the guide sleeves 36 follow this movement of the adjusting ring 10, whereby the adjusting arms 86 take up an inclined position in relation to the axis 20. The adjusting shafts 80 non-rotatably connected to the adjusting arms 86 are turned accordingly, in the counterclockwise direction when seen in radial direction inwards. This means that the angle of pitch between the guide vanes 78 and the axis 20 of the adjusting ring 10 and the compressor housing 68 is again decreased.

If, on the other hand, the adjusting ring 10 is turned along its circumference in the counterclockwise direction in relation to the compressor housing 68 by the moving means (not illustrated), this leads in a corresponding manner to the guide vanes 78 turning about the radially aligned adjusting shafts 80 in the opposite direction so that the angle of pitch between the guide vanes 78 and the axis 20 is increased.

The angle of pitch of the guide vanes 78 of the compressor may be adapted synchronously to the respective operating conditions in the manner described. As a result of the circumferential ring 26 consisting of a carbon fiber composite material, the adjusting ring 10 has a high rigidity and strength in circumferential direction while the bearers 18 consisting of aluminum ensure a high flexural stiffness of the adjusting ring 10.

Due to the high structural rigidity of the adjusting ring 10, the angle of pitch of all the guide vanes 78 of the grid 76 of guide vanes is altered synchronously in exactly the same way.

The operating temperature of the compressor is considerably higher than room temperature. The compressor housing 68 therefore expands until the operating temperature is reached, whereby the centralizers 54 arranged at the circumference of the compressor housing 68 and the sliding shoes 48 resting on the convex sliding surfaces 52 of the centralizers 54 are displaced outwards in radial direction. The bearing blocks 42 forming bearing points for the adjusting ring 10 must migrate outwards in radial direction by a corresponding distance in order to prevent the sliding shoes 48 being pressed too strongly against the convex sliding surfaces 52 of the centralizers 54 so that any sliding of the concave sliding surfaces 50 along the convex sliding surfaces 52 and, therefore, any turning of the adjusting ring 10 in circumferential direction is made more difficult or even impossible.

Such a thermal expansion compatibility between the compressor housing 68 and the adjusting ring 10 could not be achieved with an adjusting ring 10 manufactured exclusively from fiber composite materials since fiber composite materials have very much lower coefficients of thermal expansion in the direction of their fibers, which are expediently aligned in circumferential direction of the adjusting ring 10, than the customary metallic materials, from which the compressor housing 68 is produced.

In the embodiment illustrated in FIGS. 1 to 5, the required thermal expansion compatibility is brought about by the interaction of the bearers 18 which have a relatively large coefficient of thermal expansion in circumferential direction of the adjusting ring 10 with the circumferential members 14 which have a small or infinitesimal coefficient of thermal expansion in circumferential direction.

When the temperature is increased, the curvature of the ring segments 12 decreases since the bearers 18 located on the inside expand to a greater extent that the circumferential members 14 secured at the contact surfaces 16 on the bearers 18.

A similar effect is known, for example, from the bimetallic strips used for measuring temperature.

When the curvature of the ring segments 12 is decreased or they are straightened, the distance between the two ends of each ring segment 12 and, therefore, the distance between adjacent bearing blocks 42 increases. Due to this increase in the distances, the bearing blocks 42 and, therefore, the support points of the adjusting ring 10 are automatically displaced outwards in radial direction.

Figure 6:
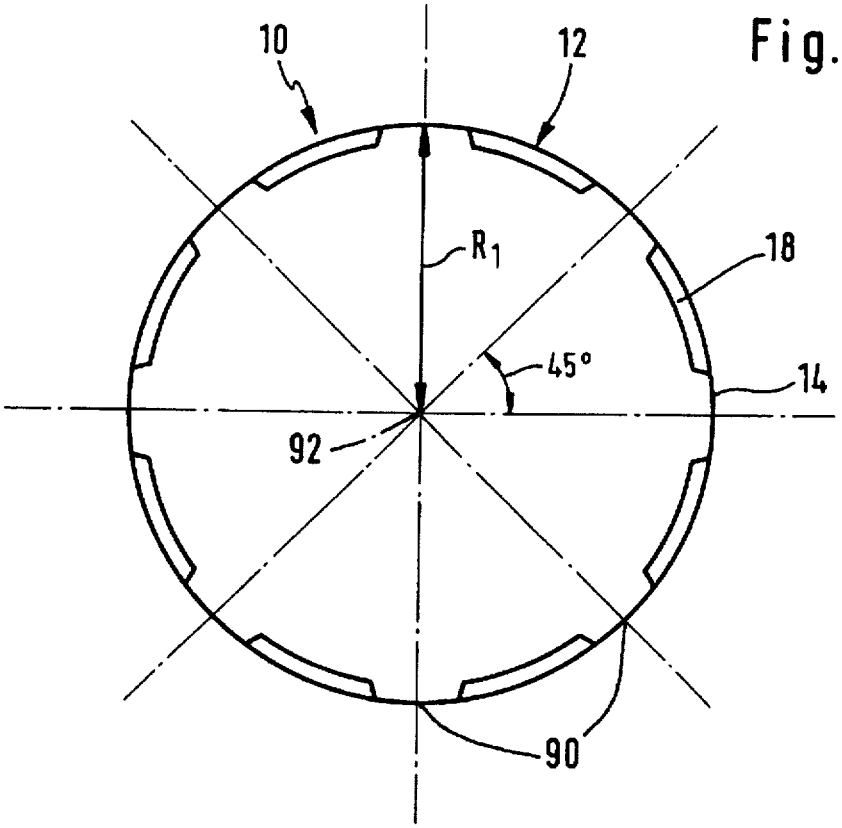
FIG. 6 is an extremely schematic plan view of an inventive adjusting ring at a resting temperature.
Figure 7:
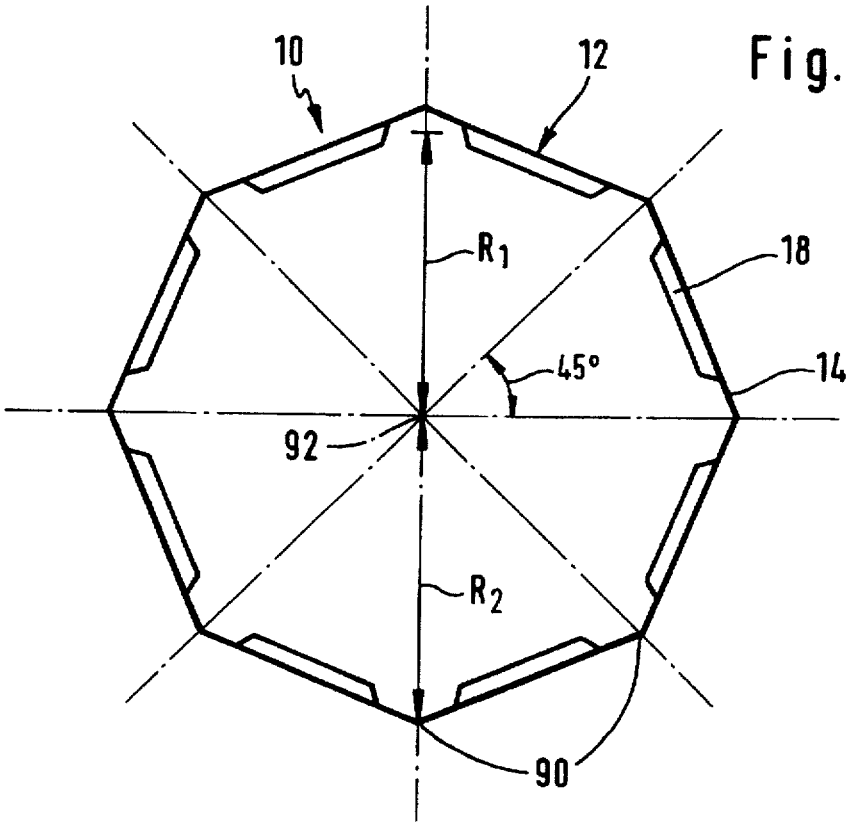
FIG. 7 is an extremely schematic plan view of the adjusting ring from FIG. 3 at an operating temperature above the resting temperature.

FIGS. 6 and 7 serve to clarify this effect.

FIG. 6 shows an extremely schematic and simplified plan view of the inventive adjusting ring 10 which is composed of eight ring segments 12, two adjacent ring segments 12 bordering on one another each time at one bearing point 90.

At a resting temperature of, for example, 20° C., the eight ring segments 12 each have essentially the shape of an octant of a circle with a radius $R_1$. Consequently, the adjusting ring 10 is, at this temperature, a circle with a radius $R_1$, from the central point 92 of which the bearing points 90 each have the distance $R_1$.

FIG. 7 is an extremely schematic illustration of the adjusting ring 10 from FIG. 6 at an operating temperature which is considerably above the resting temperature.

As a result of the different coefficients of thermal expansion of the bearers 18 and the circumferential members 14, the ring segments 12 are curved to a lesser extent at the operating temperature. To clarify the decrease in curvature of the ring segments 12, these are illustrated in FIG. 7 as straight lines which is greatly exaggerated but shows the substantial effect of altering the geometry in the clearest manner.

Due to the decrease in the curvature of the ring segments 12, the adjusting ring 10 no longer corresponds to an exact circle with a radius $R_1$ but the adjusting ring 10 is deformed to the shape of an octagon, the corners of which are formed by the bearing points 90 between the ring segments 12.

With the conditions at the resting temperature illustrated in FIG. 6, the distance between two adjacent bearing points 90 was smaller than the length of the ring segments 12 due to the curvature of the ring segments 12.

As a result of the decrease in curvature of the ring segments 12, the distance between the bearing points 90, during an increase in temperature, comes ever closer to the length of the ring segments 12 which corresponds to the respective length of the circumferential members 14 which expand only slightly and is, therefore, essentially independent of the temperature. Consequently, the distance between adjacent bearing points 90 likewise increases with an increasing temperature which automatically results in the bearing points 90 being displaced radially outwards away from the central point 92 of the adjusting ring 10 until they finally have, with the conditions illustrated in FIG. 7, a distance R2 from the central point 92 of the adjusting ring 10 which is greater than the distance $R_1$ at the resting temperature.

As already mentioned, the decrease in the curvature of the ring segments 12 and, therefore, the alteration in the distances of the bearing points 90 from the central point 92 of the adjusting ring 10 is represented in FIG. 7 in a very exaggerated manner in order to better illustrate the effect. An increase from $R_1 \approx 300$ mm to $R_2 \approx 300.5$ mm at an operating temperature higher than the resting temperature by 80K is realistic.

A suitable selection of the material for the bearers 18 and the circumferential members 14 as well as a suitable dimensioning of them can result in the bearing points 90 (the bearing blocks 42) being displaced outwards in radial direction essentially by the same amount as the sliding shoes 48, whereby the thermal expansion compatibility between the adjusting ring 10 and the compressor housing 68 is ensured.

Achieving the desired thermal expansion compatibility is made easier when the centralizers 54 have a negative coefficient of thermal expansion in radial direction and, therefore, partially compensate the expansion of the compressor housing 68.

As a result of the thermal expansion compatibility, the adjusting ring 10 can easily be turned along its circumference in relation to the compressor housing 68 by the concave sliding surfaces 50 of the sliding shoes 48 sliding along the convex sliding surfaces 52 of the centralizers 54 not only at resting temperature but also at the maximum operating temperature and at all temperatures therebetween and so an exactly synchronous alteration in the angle of pitch of the guide vanes 78 is possible in every operating state.

What is claimed is:

1. An adjusting ring for synchronous alteration of the angle of pitch of guide vanes of a compressor, said adjusting ring comprising:

a plurality of bearing points for mounting said adjusting ring on a compressor housing of the compressor;

said bearing points defining circumferentially extending curved regions of said adjusting ring such that each curved region is arranged between two adjacent bearing points; wherein:

the curvature of the curved regions decreases during an increase in the temperature of the curved regions so that the bearing points are displaced outwards in a radial direction to maintain a desired clearance between the adjusting ring and the compressor housing.

2. An adjusting ring as defined in claim 1, wherein:

the adjusting ring comprises at least three of said curved regions.

3. An adjusting ring as defined in claim 1, wherein:

the adjusting ring comprises at the most sixteen of said curved regions.

4. An adjusting ring as defined in claim 1, wherein each of said curved regions comprises:

a circumferential member arranged on an outer side of the adjusting ring and having a first coefficient of thermal expansion in the circumferential direction of the adjusting ring, and a bearer arranged on an inner side of the adjusting ring and having a second coefficient of thermal expansion in the circumferential direction of the adjusting ring; wherein:

the second coefficient of thermal expansion is greater than the first coefficient of thermal expansion; and the circumferential member and the bearer are secured together.

5. An adjusting ring as defined in claim 4, wherein:

the circumferential members comprise a fiber composite material.

6. An adjusting ring as defined in claim 5, wherein:

the circumferential members comprise a carbon fiber composite material.

7. An adjusting ring as defined in claim 5, wherein:

the circumferential members comprise a glass fiber composite material.

8. An adjusting ring as defined in claim 5, wherein:

the fibers of the fiber composite material are aligned essentially in the circumferential direction of the adjusting ring.

9. An adjusting ring as defined in claim 4, wherein:

the bearers comprise aluminum.

10. An adjusting ring as defined in claim 4, wherein:

the circumferential members of at least two adjacent ones of said curved regions are unitary.

11. An adjusting ring as defined in claim 4, wherein:

the circumferential members of the curved regions are designed as two circumferential half rings.

12. An adjusting ring as defined in claim 4, wherein:

the circumferential members of all of said curved regions are unitary.

13. An adjusting ring as defined in claim 1, wherein:

said bearing points of said adjusting ring are supported by sliding shoes;

each of said sliding shoes having a sliding surface for allowing said adjusting ring to translate circumferentially relative to corresponding sliding surfaces of said compressor housing.

14. An adjusting ring as defined in claim 13, wherein:

said sliding shoes comprise a fiber composite material.

15. An adjusting ring as defined in claim 13, wherein:

the sliding surfaces of the sliding shoes of the adjusting ring slide against corresponding sliding surfaces of adjusting ring carriers of the compressor housing.

16. An adjusting ring as defined in claim 15, wherein:

said adjusting ring carriers comprise a fiber composite material.

17. An adjusting ring as defined in claim 15, wherein:

said adjusting ring carriers have a layered structure, wherein dense fabric layers and less dense spacer layers alternate in a radial direction of the compressor.

18. An adjusting ring as defined in claim 17, wherein:

said fabric layers have a negative coefficient of thermal expansion in the radial direction of the compressor.

19. An adjusting ring as defined in claim 18, wherein said fabric layers comprise:

fibers aligned at angles of approximately plus 30° and minus 30° in relation to the radial direction of the compressor.

20. An adjusting ring as defined in claim 15, wherein:

a thermal insulation layer is arranged between the compressor housing and each of the adjusting ring carriers.

21. An adjusting ring as defined in claim 15, wherein each of said curved regions comprises:

a circumferential member arranged on an outer side of the adjusting ring and having a first coefficient of thermal expansion in the circumferential direction of the adjusting ring, and a bearer arranged on an inner side of the adjusting ring and having a second coefficient of thermal expansion in the circumferential direction of the adjusting ring; wherein:

the second coefficient of thermal expansion is greater than the first coefficient of thermal expansion;

the circumferential member and the bearer are secured together; and the coefficients of thermal expansion of the circumferential members and of the bearers are adapted to one another and to the length and the curvature of the curved regions such that the bearing points of the adjusting ring and the adjusting ring carriers are displaced radially outwards during an increase in temperature over approximately the same distance.

22. A compressor with a compressor housing, guide vanes, and an adjusting ring for the synchronous alteration of the angle of pitch of the guide vanes, wherein said adjusting ring comprises:

a plurality of bearing points for mounting said adjusting ring on said compressor housing;

said bearing points defining circumferentially extending curved regions of said adjusting ring such that each curved region is arranged between two adjacent bearing points; wherein:

the curvature of the curved regions decreases during an increase in the temperature of the curved regions so that the bearing points are displaced outwards in a radial direction to maintain a desired clearance between the adjusting ring and the compressor housing.

* * * * *